United States Patent [19]

Sequeira, Jr. et al.

[11] 4,212,070

[45] Jul. 8, 1980

[54] CONTROL SYSTEM FOR A FURFURAL REFINING UNIT RECEIVING HEAVY SWEET CHARGE OIL

[75] Inventors: Avilino Sequeira, Jr.; John D. Begnaud; Frank L. Barger, all of Port Arthur, Tex.

[73] Assignee: Texaco Inc., White Plains, N.Y.

[21] Appl. No.: 912,908

[22] Filed: Jun. 5, 1978

Related U.S. Application Data

[63] Continuation of Ser. No. 851,912, Nov. 16, 1977, abandoned.

[51] Int. Cl.[2] ..... G06G 7/58; C10G 21/00

[52] U.S. Cl. ..... 364/500; 196/14.52; 208/311; 208/DIG. 1

[58] Field of Search ..... 364/500, 502, 496, 501; 208/33, 311, DIG. 1; 196/14.52, 132, 14.5

[56] References Cited

U.S. PATENT DOCUMENTS

| | | | |
|---|---|---|---|
| 3,546,107 | 12/1970 | Brown et al. | 364/502 X |
| 3,686,488 | 8/1972 | Woodle | 364/500 |
| 3,718,809 | 2/1973 | Woodle | 364/500 |
| 3,799,871 | 3/1974 | Sequeira, Jr. | 364/500 X |
| 3,972,779 | 8/1976 | Harrison | 364/500 X |

*Primary Examiner*—Joseph F. Ruggiero

*Attorney, Agent, or Firm*—Robert A. Kulason; Carl G. Ries; Ronald G. Gillespie

[57] ABSTRACT

A furfural refining unit treats heavy sweet charge oil with a furfural solvent in a refining tower to yield raffinate and extract mix. The furfural is recovered from the raffinate and from the extract mix and returned to the refining tower. A system controlling the refining unit includes a gravity analyzer, a flash point temperature analyzer, a sulfur analyzer and viscosity analyzers; all analyzing the heavy sweet charge oil and providing corresponding signals, sensors sense the flow rates of the charge oil and the solvent flowing into the refining tower and the temperature of the extract mix and provide corresponding signals. One of the flow rates of the heavy sweet charge oil and the furfural flow rates is controlled in accordance with the signals from all the analyzers and all the sensors, while the other flow rate of the heavy sweet charge oil and the furfural flow rates is constant.

8 Claims, 14 Drawing Figures

CONTROL SYSTEM FOR A FURFURAL REFINING UNIT RECEIVING HEAVY SWEET CHARGE OIL

CROSS REFERENCE TO RELATED APPLICATIONS

This application is a continuation as to all subject matter common to U.S. application Ser. No. 851,912 filed Nov. 16, 1977 now abandoned by Avilino Sequeira, Jr., John D. Begnaud and Frank. L. Barger, and assigned to Texaco Inc., assignee of the present invention, and a continuation-in-part for additional subject matter.

BACKGROUND OF THE INVENTION

Field of the Invention

The present invention relates to control systems and methods in general and, more particularly, to control systems and methods for oil refining units.

SUMMARY OF THE INVENTION

A furfural refining unit treats heavy sweet charge oil with a furfural solvent in a refining tower to yield raffinate and extract mix. The furfural is recovered from the raffinate and from the extract mix and returned to the refining tower. A system controlling the refining unit includes a gravity analyzer, a flash point temperature analyzer, a sulfur analyzer and viscosity analyzers. The analyzers analyze the heavy sweet charge oil and provide corresponding signals. Sensors sense the flow rates of the charge oil and the furfural flowing into the refining tower and the temperature of the extract mix and provide corresponding signals. The flow rate of the heavy sweet charge oil of the furfural is controlled in accordance with the signals provided by all the sensors and the analyzers while the other flow rate of the heavy sweet charge oil and the furfural flow rates is constant.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
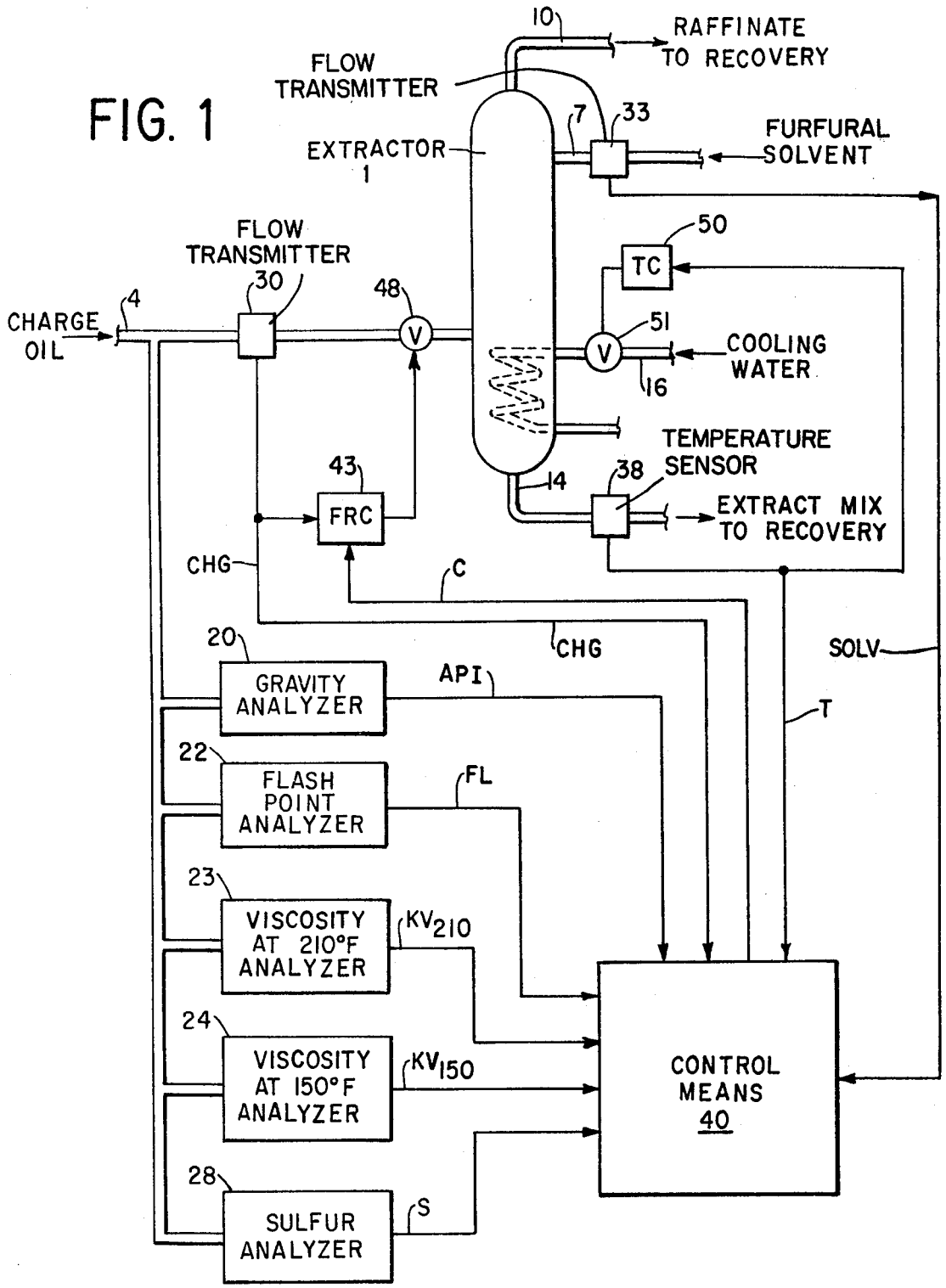
FIG. 1 shows a furfural refining unit in partial schematic form and a control system, constructed in accordance with the present invention, in simple block diagram form.

An extractor 1 in a furfural refining unit is receiving heavy sweet charge oil by way of a line 4 and furfural solvent by way of a line 7 and providing raffinate to recovery by way of a line 10, and an extract mix to recovery by way of a line 14.

Heavy sweet charge oil is a charge oil having a sulfur content less than a predetermined sulfur content and having a kinematic viscosity, corrected to a predetermined temperature, greater than a predetermined kinematic viscosity. Preferably, the predetermined sulfur content is 1.0%, the predetermined temperature is 210° F., and the predetermined kinematic viscosity is 15.0, respectively. The temperature in extractor 1 is controlled by cooling water passing through a line 16. A gravity analyzer 20, flash point analyzer 22 and viscosity analyzers 23 and 24, and a sulfur analyzer 28 sample the charge oil in line 4 and provide signals API, FL, $KV_{210}$, $KV_{150}$ and S, respectively, corresponding to the API gravity, the flash point, the kinematic viscosity at 210° F. & 150° F., and sulfur content, respectively.

A flow transmitter 30 in line 4 provides a signal CHG corresponding to the flow rate of the charge oil in line 4. Another flow transmitter 33 in line 7 provides a signal SOLV corresponding to the furfural flow rate. A temperature sensor 38, sensing the temperature of the extract mix leaving extractor 1, provides a signal T corresponding to the sensed temperature. All signals hereinbefore mentioned are provided to control means 40.

Control means 40 provides signal C to a flow recorder controller 43. Recorder controller 43 receives signals CHG and C and provides a signal to a valve 48 to control the flow rate of the charge oil in line 4 in accordance with signals CHG and C so that the charge oil assumes a desired flow rate. Signal T is also provided to temperature controller 50. Temperature controller 50 provides a signal to a valve 51 to control the amount of cooling water entering extractor 1 and hence the temperature of the extract-mix in accordance with its set point position and signal T.

The following equations are used in practicing the present invention for heavy sweet charge oil:

$$H_{210}=\ln\ln(KV_{210}+C_1) \quad (1)$$

where $H_{210}$ is a viscosity H value for 210° F., $KV_{210}$ is the kinematic viscosity of the charge oil at 210° F. and $C_1$ is a constant having a preferred value of 0.6.

$$H_{150}=\ln\ln(KV_{150}+C_1) \quad (2)$$

where $H_{150}$ is a viscosity H value for 150° F., and $KV_{150}$ is the kinematic viscosity of the charge oil at 150° F.

$$K_{150}=[C_2-\ln(T_{150}+C_3]/C_4 \quad (3)$$

where $K_{150}$ is a constant needed for estimation of the kinematic viscosity at 100° F., $T_{150}$ is 150, and $C_2$ through $C_4$ are constants having preferred values of 6.5073, 460 and 0.17937, respectively.

$$H_{100}=H_{210}+(H_{150}-H_{210})/K_{150} \quad (4)$$

where $H_{100}$ is a viscosity H value for 100° F.

$$KV_{100}=\exp[\exp(H_{100})]-C_1 \quad (5)$$

where $KV_{100}$ is the kinematic viscosity of the charge oil at 100° F.

$$SUS = C_5(KV_{210}) + [C_6 + C_7(KV_{210})]/[C_8 + C_9(KV_{210}) + \quad 6.$$

-continued $$C_{10}(KV_{210})^2 + C_{11}(KV_{210})^3](C_{12})$$

where SUS is the viscosity in Saybolt Universal Seconds and $C_5$ through $C_{12}$ are constants having preferred values of 4.6324, 1.0, 0.03264, 3930.2, 262.7, 23.97, 1.646 and $10^{-5}$, respectively.

$$SUS_{210}=[C_{13}+C_{14}(C_{15}-C_{16})]SUS \quad (7)$$

where $SUS_{210}$ is the viscosity in Saybolt Universal Seconds at 210° F. and $C_{13}$ through $C_{16}$ are constants having preferred values of 1.0, 0.000061, 210 and 100, respectively.

$$W = C_{43} - C_{44}API + C_{45}/KV_{210} - C_{46}S + C_{47}(API)^2 - C_{48}API/KV_{210} + C_{49}(S)(API), \quad 8.$$

where W is the percent wax in the charge oil, and $C_{43}$ through $C_{49}$ are constants having preferred values of 51.17 4.3135, 182.83, 5.2388, 0.101, 6.6106 and 0.19609, respectively.

$$VI_{DWCO} = -C_{67} + C_{68}(KV_{210})^2 + C_{69}(VI) - C_{70}(API)(VI) + C_{71}(API)^2 + C_{72}(FL)(VI) - C_{73}(W)(KV_{210}), \quad 9.$$

where $C_{67}$ through $C_{73}$ are constants having preferred values of 168.538, 0.0468, 3.63863, 0.17523, 0.41542, 0.00106 and 0.21918, respectively.

$$VI_{DWCP}=VI_{DWCO}+(\text{Pour})[C_{21}-C_{22}\ln SUS_{210}+C_{23}(\ln SUS_{210})^2] \quad (10)$$

where $VI_{DWCP}$ and Pour are the viscosity index of the dewaxed charge at a predetermined temperature and the Pour Point of the dewaxed product, respectively, and $C_{21}$ through $C_{23}$ are constants having preferred values of 2.856, 1.18 and 0.126, respectively.

$$\Delta VI=VI_{RO}-VI_{DWCO}=VI_{RP}-VI_{DWCP} \quad (11)$$

where $VI_{RO}$ and $VI_{RP}$ are the VI of the refined oil at 0° F., and the predetermined temperature, respectively.

$$A = C_{74} - C_{75}(KV_{210})^2 + C_{76}(S) + C_{77}(FL)^2 - C_{78}(FL)(API) - C_{79}(KV_{210})(S), \quad 12.$$

where $C_{74}$ through $C_{79}$ are constants having preferred values of 503.518, 0.04423, 54.58305, 0.00055, 0.03745 and 1.38869.

$$J=(\Delta VI-C_{80}-C_{81}\sqrt{T})/[-C_{82}T+C_{83}(A)(T)], \quad (13)$$

where J is the furfural dosage and $C_{80}$ through $C_{83}$ are constants having preferred values of 10.272, 1.0194, 0.00067611 and 0.000004029, respectively.

$$C=(SOLV)\,(100)/J \quad (14)$$

where C is the new charge oil flow rate.

Figure 2:
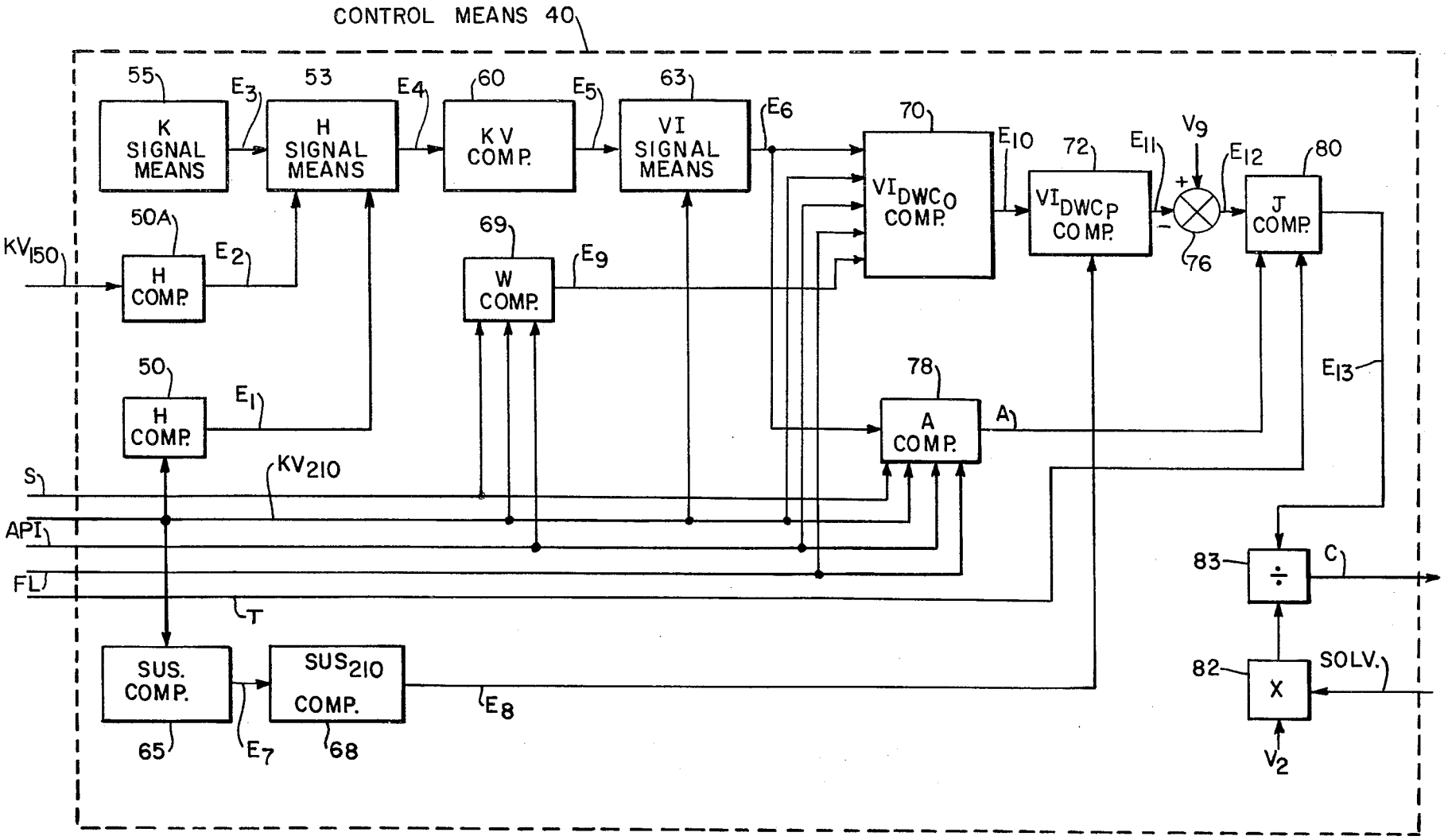
FIG. 2 is a detailed block diagram of the control means shown in FIG. 1.

Referring now to FIG. 2, signal $KV_{210}$ is provided to an H computer 50 in control means 40, while signal $KV_{150}$ is applied to an H computer 50A. It should be noted that elements having a number and a letter suffix are similar in construction and operation as to those elements having the same numeric designation without a suffix. All elements in FIG. 2, except elements whose operation is obvious, will be disclosed in detail hereinafter. Computers 50 and 50A provide signals $E_1$ and $E_2$ corresponding to $H_{210}$ and $H_{150}$, respectively, in equations 1 and 2, respectively, to H signal means 53. K signal means 55 provides a signal $E_3$ corresponding to the term $K_{150}$ in equation 3 to H signal means 53. H signal means 53 provides a signal $E_4$ corresponding to the term $H_{100}$ in equation 4 to a KV computer 60 which provides a signal $E_5$ corresponding to the term $KV_{100}$ in accordance with signal $E_4$ and equation 5 as hereinafter explained.

Signals $E_5$ and $KV_{210}$ are applied to VI signal means 63 which provides a signal $E_6$ corresponding to the viscosity index.

An SUS computer 65 receives signal $KV_{210}$ and provides a signal $E_7$ corresponding to the term SUS in accordance with the received signals and equation 6 as hereinafter explained.

An SUS 210 computer 68 receives signal $E_7$ and applies signal $E_8$ corresponding to the term $SUS_{210}$ in accordance with the received signal and equation 7 as hereinafter explained.

A W computer 69 receives signals $KV_{210}$, S and API and provides a signal $E_9$ corresponding to the term W in equation 8 in accordance with the received signals and equation 8 as hereinafter explained.

A $VI_{DWCO}$ computer 70 receives signal RI, $E_9$, API, FL and $E_6$ and provides a signal $E_{10}$ corresponding to the term $VI_{DWCO}$ in accordance with the received signals and equation 9 as hereinafter explained.

A $VI_{DWCP}$ computer 72 receives a signal $E_8$ and $E_{10}$ and provides a signal $E_{11}$ corresponding to the term $VI_{DWCP}$ in accordance with the received signals and equation 10. Subtracting means 76 performs the function of equation 11 by subtracting signal $E_{11}$ from a direct current voltage $V_9$, corresponding to the term $VI_{RP}$, to provide a signal $E_{12}$ corresponding to the term $\Delta VI$ in equation 11.

An A computer 79 receives signals $KV_{210}$, API,S and FL and provides a signal A corresponding to the term A in equation 12, in accordance with the received signals and equation 12 as hereinafter explained.

A J computer 80 receives signals T, A and $E_2$ and provide a signal $E_{13}$ corresponding to the term J in accordance with the received signals and equation 13 as hereinafter explained to a divider 83.

Signal SOLV is provided to a multiplier 82 where it is multiplied by a direct current voltage $V_2$ corresponding to a value of 100 to provide a signal corresponding to the term (SOLV) (100) in equation 14. The product signal is applied to divider 83 where it is divided by signal $E_{13}$ to provide signal C corresponding to the desired new charge oil flow rate.

It would be obvious to one skilled in the art that if the charge oil flow rate was maintained constant and the furfural flow rate varied, equation 14 would be rewritten as $$SO=(J)\,(CHG)/100 \quad (15)$$

where SO is the new furfural flow rate. Control means 40 would be modified accordingly.

Figure 3:
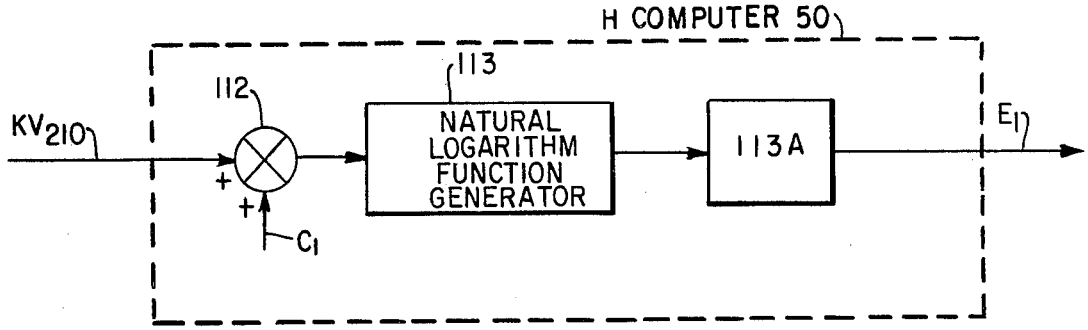
FIGS. 3 through 14 are detailed block diagrams of the H computer, the K signal means, the H signal means, the KV computer, the VI signal means, the SUS computer, the $SUS_{210}$ computer, the W computer, the $VI_{DWCO}$ computer, the $VI_{DWCP}$ computer, the A computer and the J computer, respectively, shown in FIG. 2.

Referring now to FIG. 3, H computer 50 includes summing means 112 receiving signal $KV_{210}$ and summing it with a direct current voltage $C_1$ to provide a signal corresponding to the term $[KV_{210}+C_1]$ shown in equation 1. The signal from summing means 112 is applied to a natural logarithm function generator 113 which provides a signal corresponding to the natural log of the sum signal which is then applied to another natural log function generator 113A which in turn provides signal $E_{10}$.

Figure 4:
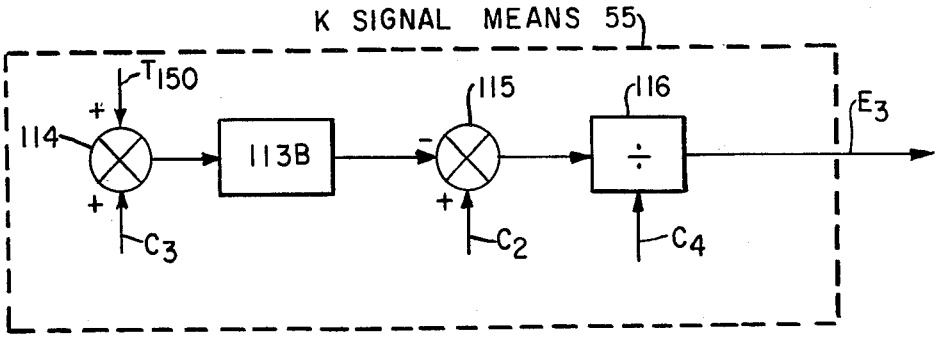

Referring now to FIG. 4, K signal means 55 includes summing means 114 summing direct current voltages $T_{150}$ and $C_3$ to provide a signal corresponding to the term $[T_{150}+C_3]$ which is provided to a natural log function generator 113B which in turn provides a signal corresponding to the natural log of the sum signal from summing means 114. Subtracting means 115 subtracts the signal provided by function generator 113B from a direct current voltage $C_2$ to provide a signal corresponding to the numerator of equation 3. A divider 116 divides the signal from subtracting means 115 with a direct current voltage $C_4$ to provide signal $E_3$.

Figure 5:
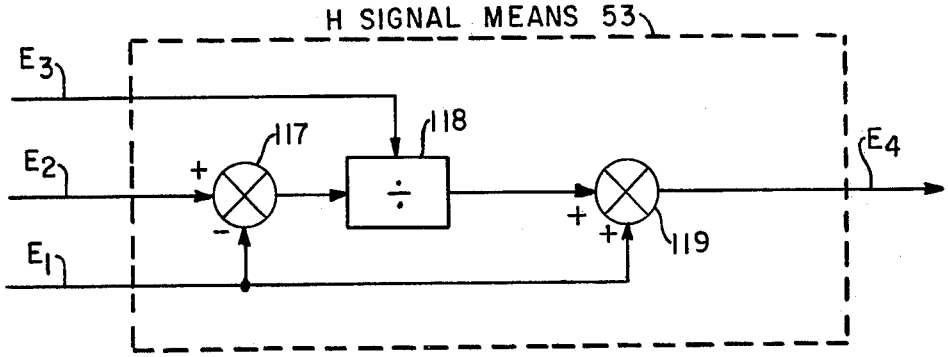

Referring now to FIG. 5, H signal means 53 includes subtracting means 117 which subtracts signal $E_1$ from signal $E_2$ to provide a signal corresponding to the term $H_{150}-H_{210}$, in equation 4, to a divider 118. Divider 118 divides the signal from subtracting means 117 by signal $E_3$. Divider 114 provides a signal which is summed with signal $E_1$ by summing means 119 to provide signal $E_4$ corresponding to $H_{100}$.

Figure 6:
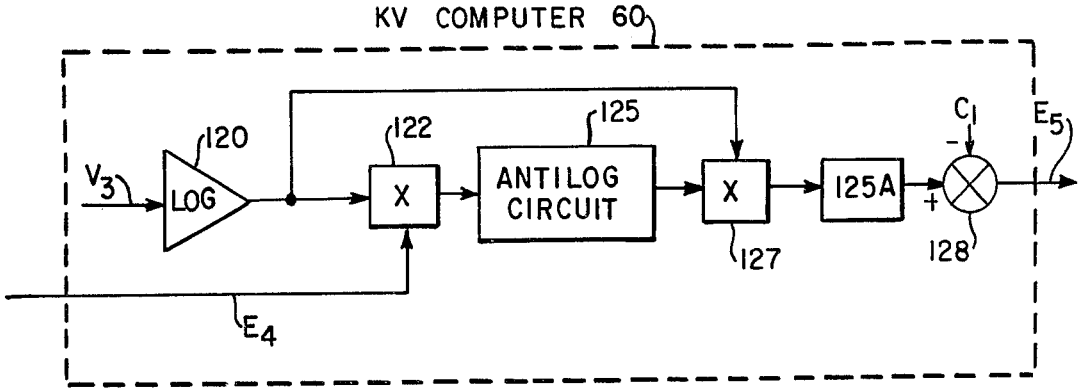

Referring now to FIG. 6, a direct current voltage $V_3$ is applied to a logarithmic amplifier 120 in KV computer 60. Direct current voltage $V_3$ corresponds to the mathematical constant e. The output from amplifier 120 is applied to a multiplier 122 where it is multiplied with signal $E_4$. The product signal from multiplier 122 is applied to an antilog circuit 125 which provides a signal corresponding to the term exp $(H_{100})$ in equation 5. The signal from circuit 125 is multiplied with the output from logarithmic amplifier 120 by a multiplier 127 which provides a signal to antilog circuit 125A. Circuit 125A is provided to subtracting means 128 which subtracts a direct current voltage $C_1$ from the signal from circuit 125A to provide signal $E_5$.

Figure 7:
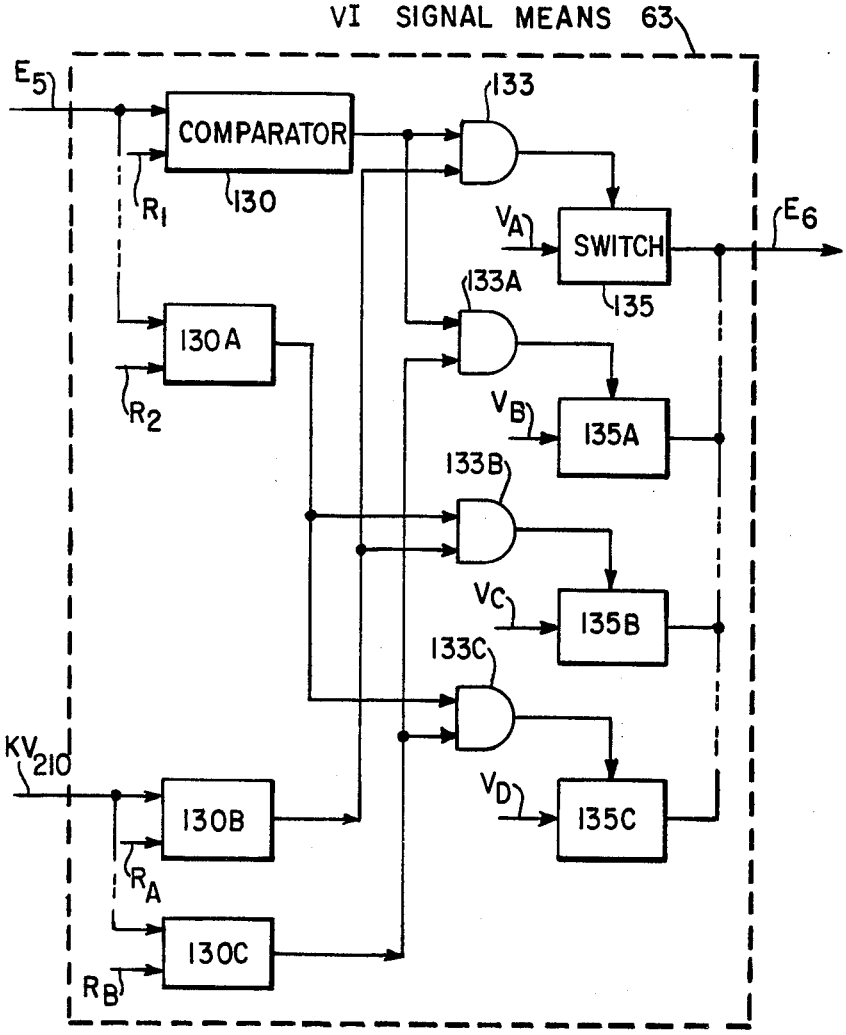

Referring now to FIG. 7, VI signal means 63 is essentially memory means which is addressed by signals $E_5$, corresponding to $KV_{100}$, and signal $KV_{210}$. In this regard, a comparator 130 and comparator 130A represent a plurality of comparators which receive signal $E_5$ and compare signal $E_5$ to reference voltages, represented by voltages $R_1$ and $R_2$, so as to decode signal $E_5$. Similarly, comparators 130B and 130C represent a plurality of comparators receiving signal $KV_{210}$ which compare signal $KV_{210}$ with reference voltages RA and RB so as to decode signal $KV_{210}$. The outputs from comparators 130 and 130B are applied to an AND gate 133 whose output controls a switch 135. Thus, should comparators 130 and 130B provide a high output, AND gate 133 is enabled and causes switch 135 to be rendered conductive to pass a direct current voltage $V_A$ corresponding to a predetermined value, as signal $E_6$ which corresponds to VI. Similarly, the outputs of comparators 130 and 130C control an AND gate 133A which in turn controls a switch 135A to pass or to block a direct current voltage $V_B$. Similarly, another AND gate 133B is controlled by the outputs from comparators 130A and 130B to control a switch 135B so as to pass or block a direct current voltage $V_C$. Again, an AND gate 133C is controlled by the outputs from comparators 130A and 130C to control a switch 135C to pass or to block a direct current voltage $V_D$. The outputs of switches 135 through 135C are tied together so as to provide a common output.

Figure 8:
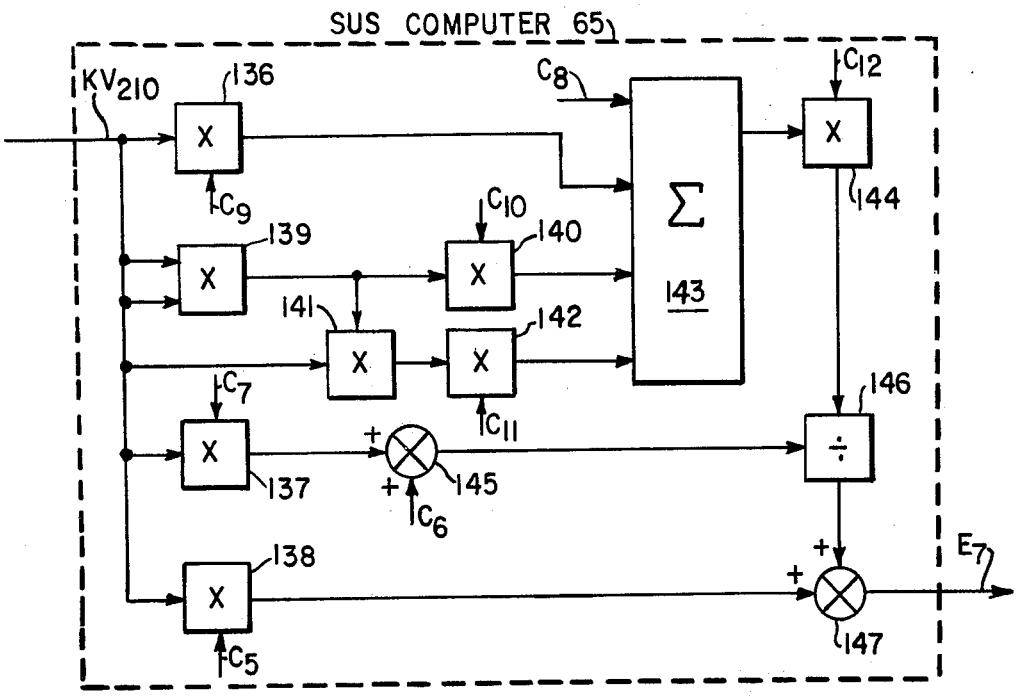

Referring now to FIG. 8, the SUS computer 65 includes multipliers 136, 137 and 138 multiplying signal $KV_{210}$ with direct current voltages $C_9$, $C_7$ and $C_5$, respectively, to provide signals corresponding to the terms $C_9(KV_{210})$, $C_7(KV_{210})$ and $C_5(KV_{210})$, respectively in equation 6. A multiplier 138 effectively squares signal $KV_{210}$ to provide a signal to multipliers 140, 141. Multiplier 140 multiplies the signal from multiplier 139 with a direct current voltage $C_{10}$ to provide a signal corresponding to the term $C_{10}(KV_{210})^2$ in equation 6. Multiplier 141 multiplies the signal from multiplier 139 with signal $KV_{210}$ to provide a signal corresponding to $(KV_{210})^3$. A multiplier 142 multiplies the signal from multiplier 141 with a direct current voltage $C_{11}$ to provide a signal corresponding to the term $C_{11}(KV_{210})^3$ in equation 6. Summing means 143 sums the signals from multipliers 136, 140 and 142 with a direct current voltage $C_8$ to provide a signal to a multiplier 144 where it is multiplied with a direct current voltage $C_{12}$. The signal from multiplier 137 is summed with a direct current voltage $C_6$ by summing means 145 to provide a signal corresponding to the term $[C_6+C_7(KV_{210}]$. A divider 146 divide the signal provided by summing means 145 with the signal provided by multiplier 144 to provide a signal which is summed with the signal from multiplier 138 by summing means 147 to provide signal $E_7$.

Figure 9:
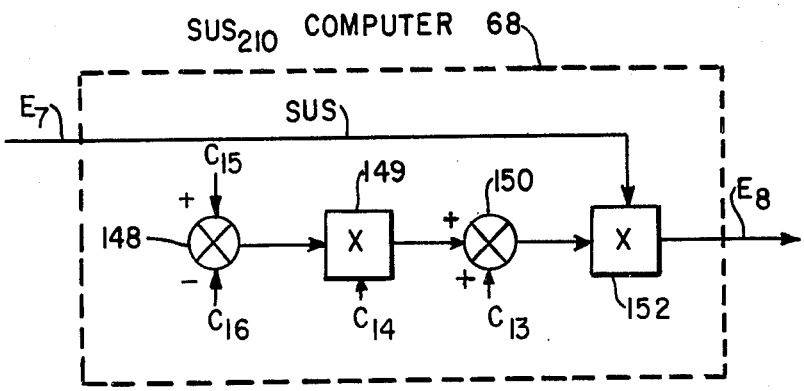

Referring now to FIG. 9, $SUS_{210}$ computer 68 includes subtracting means 148 which subtracts a direct current voltage $C_{16}$ from another direct current voltage $C_{16}$ from another direct current voltage $C_{15}$ to provide a signal corresponding to the term $(C_{15}-C_{16})$ in equation 7. The signal from subtracting means 148 is multiplied with a direct current voltage $C_{14}$ by a multiplier 149 to provide a product signal which is summed with another direct current voltage $C_{13}$ by summing means 150. Summing means 150 provides a signal corresponding to the term $[C_{13}+C_{14}(C_{15}-C_{16}]$ in equation 7. The signal from summing means 150 is multiplied with signal $E_7$ by a multiplier 152 to provide signal $E_8$.

Figure 10:
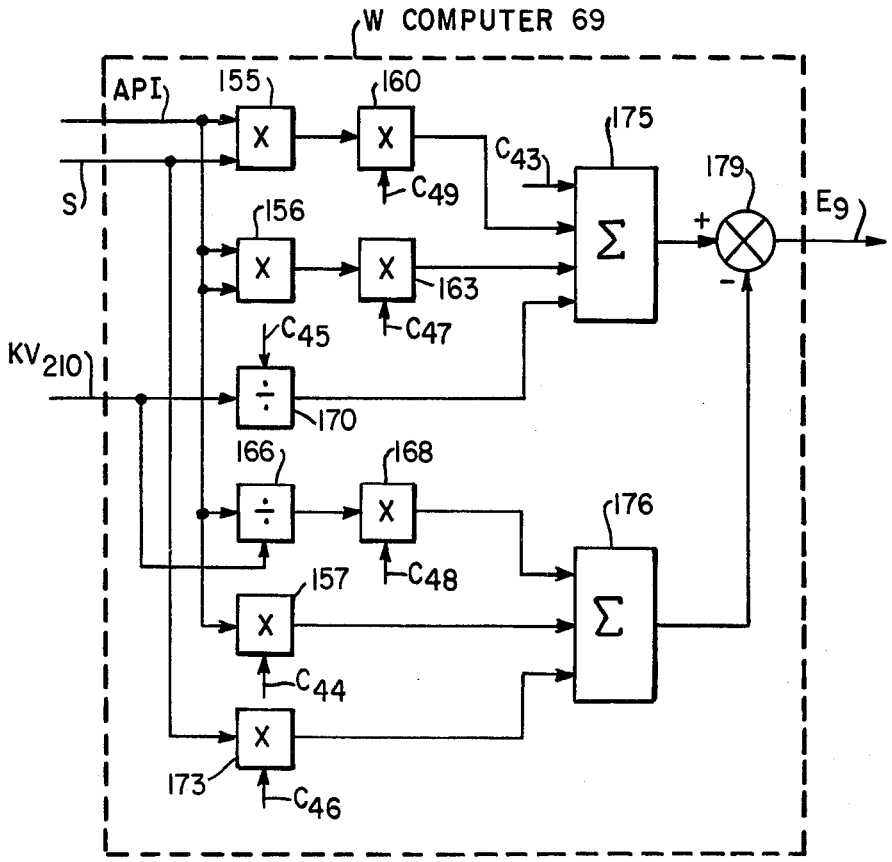

Referring now to FIG. 10, there is shown W computer 69 having multipliers 155, 156 and 157 receiving signal API. Multiplier 155 multiplies signal API with signal S to provide a product signal to another multiplier 160 where it is multiplied with a direct current voltage $C_{49}$ to provide a signal corresponding to the term $C_{49}$ (S) (API) in equation 8. Multiplier 156 effectively squares signal API and provides a signal to another multiplier 163 where it is multiplied with a direct current voltage $C_{47}$ to provide a signal corresponding to the term $(C_{47})$ $(API)^2$. Multiplier 157 multiplies signal API with a direct current voltage $C_{44}$ to provide a signal corresponding to the term $C_{44}$(API). A divider 166 divides signal API with signal $KV_{210}$ to provide another signal to a multiplier 168 where it is multiplied with a direct current voltage $C_{48}$ which in turn provides a signal corresponding to the term $[C_{48}(API)/(KV_{210})]$ in equation 8. A divider 170 divides a direct current voltage $C_{45}$ with signal $KV_{210}$ to provide a signal corresponding to the term $C_{45}/(KV_{210})$. A multiplier 173 multiplies signal S with a direct current voltage $C_{46}$. Summing means 175 sums a direct current voltage $C_{43}$ with the signals provided by multipliers 160, 163 and divider 170. Other summing means 176 sums the signals provided by multipliers 157, 168 and 173. Subtracting means 179 subtracts the signal provided by summing means 176 from the signal provided by summing means 175 to provide signal $E_9$.

Figure 11:
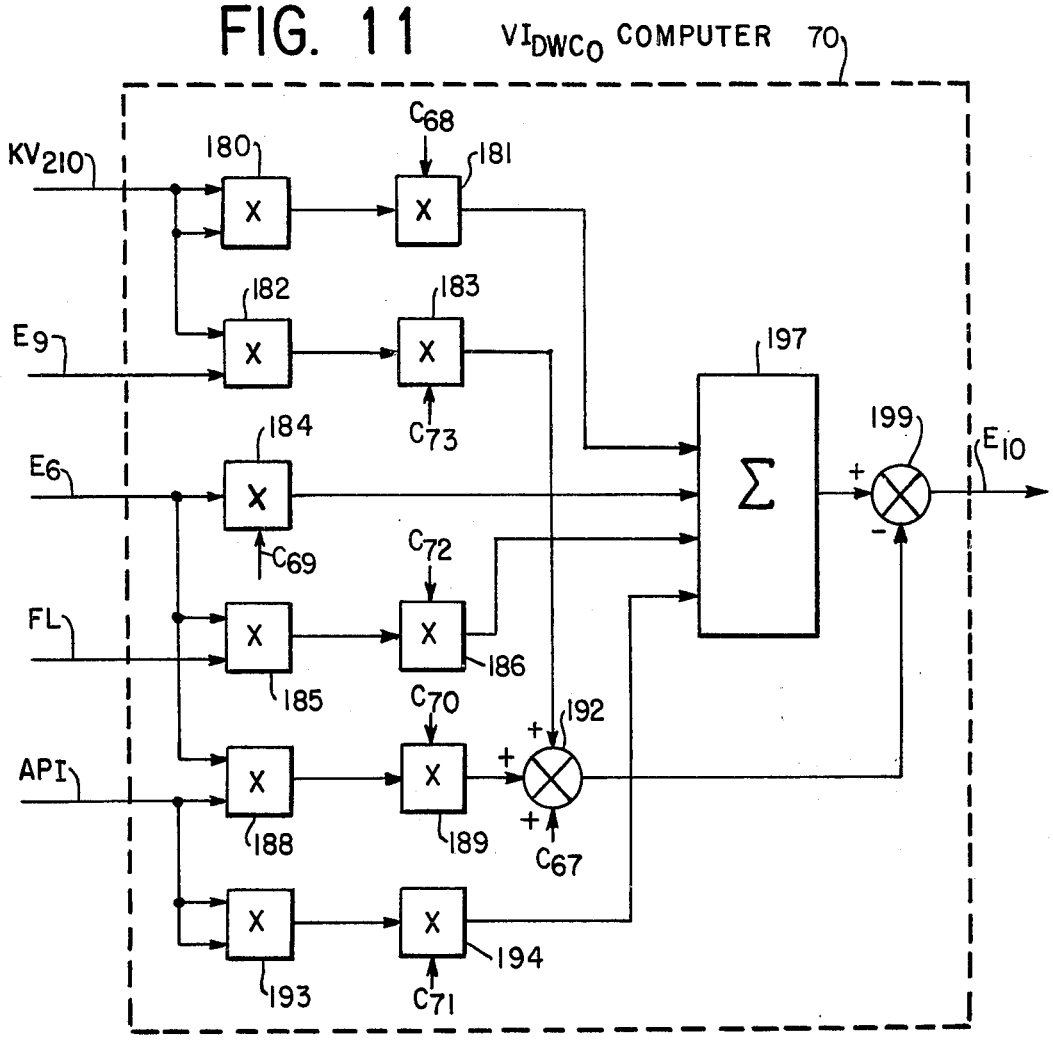

Referring now to FIG. 11, $VI_{DWCO}$ computer 70 includes a multiplier 180 which effectively squares signal $KV_{210}$ and provides it to a multiplier 181 where it is multiplied direct current voltage $C_{68}$. Multiplier 181 provides a signal corresponding to the term $C_{68}(KV_{210})^2$ in equation 9. A multiplier 182 multiplies signals $KV_{210}$, $E_9$ to provide a signal to another multiplier 183 where it is multiplied with direct current voltage $C_{73}$. Multiplier 183 provides a signal corresponding to the term $C_{73}(W)$ $(KV_{210})$ in equation 9. A multiplier 184 multiplies signal $E_6$ with a direct current voltage $C_{69}$ to provide a signal corresponding to the term $C_{69}(VI)$ in equation 9. Another multiplier 185 multiplies signals $E_6$, FL to provide a signal to a multiplier 186 where it is multiplied with a direct current voltage $C_{72}$. Multiplier 186 provides a signal corresponding to the term $C_{72}(FL)$ (VI) in equation 9. A multiplier 188 multiplies signals $E_6$, API to provide a signal to another multiplier 189 where it is multiplied with direct current voltage $C_{70}$. Product signals provided by multipliers 183, 189 are summed with another direct current voltage $C_{67}$ by summing means 192 to provide a signal corresponding to the term $-C_{67}-C_{70}(API)$ (VI)$-C_{73}(W)$ $(KV_{210})$. A multiplier 193 effectively squares signal API and provides it to a multiplier 194 where it is multiplied with a direct current voltage $C_{71}$. Multiplier 194 provides a signal corresponding to the term $C_{71}(API)^2$ in equation 9. Summing means 197 sums the signal from multipliers 181, 184, 186 and 196. Subtracting means 199 subtracts the signal provided by summing means 192 from the signal provided by summing means 197 to provide signal $E_{10}$.

Figure 12:
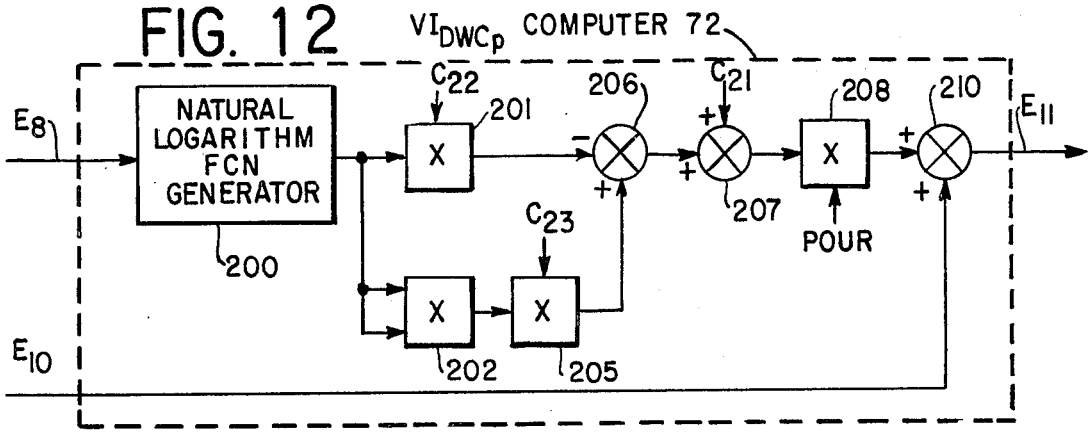

$VI_{DWCP}$ computer 72 shown in FIG. 12, includes a natural logarithm function generator 200 receiving signal $E_8$ and providing a signal corresponding to the term $1nSUS_{210}$ to multipliers 201 and 202. Multiplier 201 multiplies the signal from function generator 200 with a direct current voltage $C_{22}$ to provide a signal corresponding to the term $C_{22}1n\ SUS_{210}$ in equation 10. Multiplier 202 effectively squares the signal from function generator 200 to provide a signal that is multiplied with the direct current voltage $C_{23}$ by a multiplier 205. Multiplier 205 provides a signal corresponding to the term $C_{23}$ $(1n\ SUS_{210})^2$ in equation 10. Subtracting means 206 subtracts the signals provided by multiplier 201 from the signal provided by multiplier 205. Summing means 207 sums the signal from subtracting means 206 with a direct current voltage $C_{21}$. A multiplier 208 multiplies the sum signals from summing means 207 with a direct current voltage POUR to provide a signal which is summed with signal $E_9$ by summing means 210 which provides signal $E_{11}$.

Figure 13:
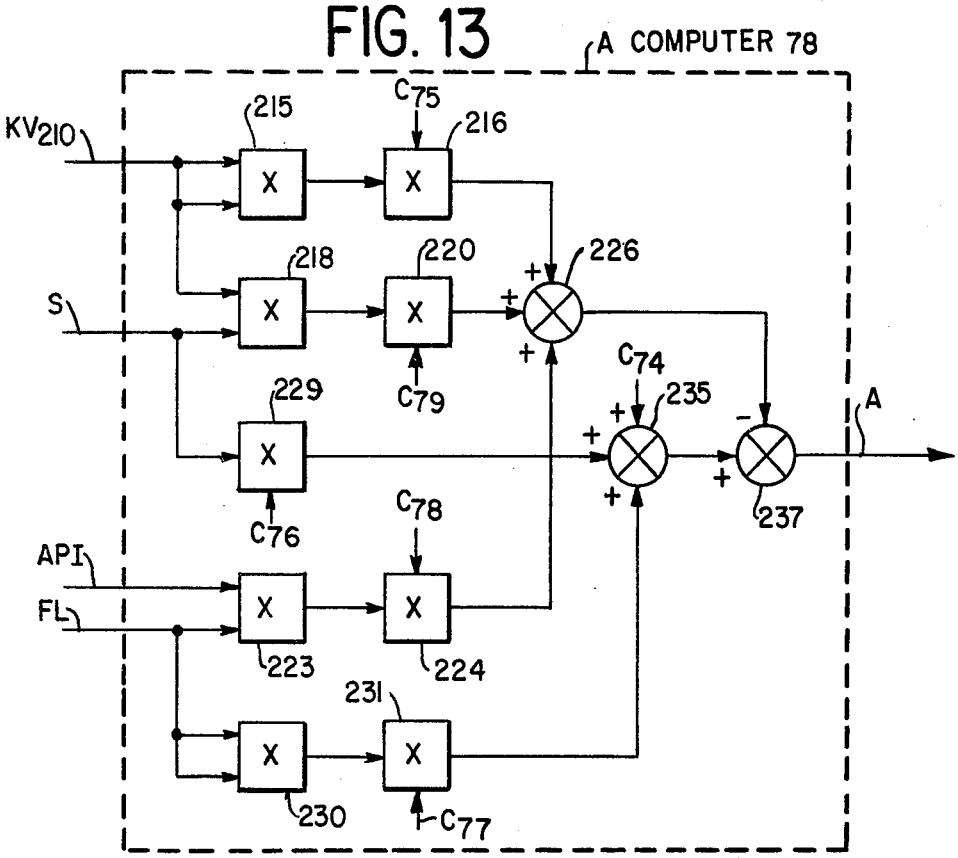

FIG. 13 shows A computer 78 having a multiplier 215 effectively squaring signal $KV_{210}$ to provide a signal which is multiplied with a direct current voltage $C_{75}$ by a multiplier 216 which provides a signal corresponding to the term $C_{75}(KV_{210})^2$ in equation 12. Multiplier 218 multiplies signals $KV_{210}$, S to provide a signal that is multiplied with a direct current voltage $C_{79}$ by a multiplier 220. Multiplier 220 provides a signal corresponding to the term $C_{79}$ $(KV_{210})$ (S) in equation 12. A multiplier 223 multiplies signals API, FL to provide a signal to another multiplier 224 where it multiplies a direct current voltage $C_{78}$. Multiplier 224 provides a signal corresponding to the term $C_{78}(FL)$ (API) in equation 12. Summing means 226 essentially sums all of the negative terms in equation 12 by summing the signals from multipliers 216, 220 and 224. A multiplier 229 multiplies signal S with a direct current voltage $C_{76}$ to provide a signal corresponding to the term $C_{76}(S)$ in equation 12. Another multiplier 230 effectively squares signal FL and provides it to yet another multiplier 231 where it is multiplied with a direct current voltage $C_{77}$. Multiplier 231 provides a signal corresponding to the term $C_{77}(FL)^2$. Summing means 235 essentially sums the positive terms of equation 12 by summing a direct current voltage $C_{74}$ with the signals provided by multipliers 229 and 231. Subtracting means 237 subtracts the signal provided by summing means 236 from the signal provided by summing means 235 to provide signal A.

Figure 14:
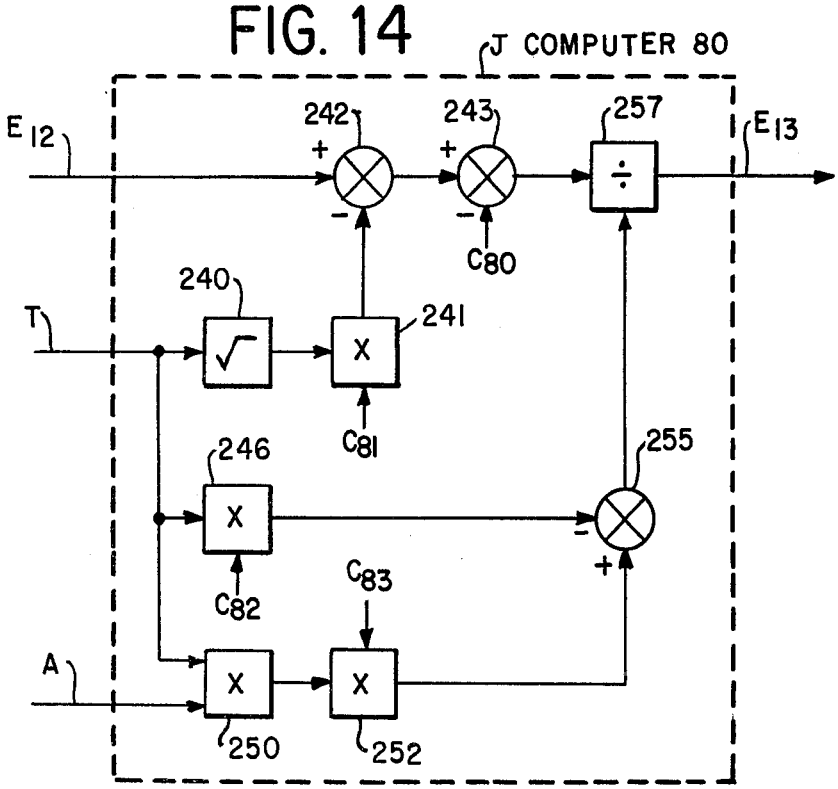

Referring now to FIG. 14, J computer 80 includes a square root circuit 240 receiving signal T and providing a signal to a multiplier 241 where it is multiplied with a direct current voltage $C_{81}$ to provide a signal to subtracting means 242. Subtracting means 242 subtracts a signal provided by multiplier 241 from signal $E_{12}$ to provide a signal corresponding to the term $\Delta VI-C_{81}\sqrt{T}$ in equation 13. Subtracting means 242 provides a signal to another subtracting means 243 which subtracts a direct current voltage $C_{80}$ to provide a signal corresponding to the term $(\Delta VI-C_{80}-C_{81}\sqrt{T})$ in equation 13. A multiplier 246 multiplies signal T with a direct current voltage $C_{82}$ to provide a signal corresponding to the term $C_{82}T$ in equation 13. Another multiplier 250 multiplies signal T with signal A to provide a signal to another multiplier 252 where it is multiplied with a direct current voltage $C_{83}$. Multiplier 252 provides a signal corresponding to the term $C_{83}(A)$ (T) in equation 13. Subtracting means 255 subtracts the product signal from multiplier 246 from the signal provided by multiplier 252 to provide a signal which is divided into the signal provided by subtracting means 243 by a divider 257. Divider 257 provides signal $E_{13}$.

The present invention as hereinbefore described controls a furfural refining unit receiving heavy sweet charge oil to achieve a desired charge oil flow rate for a constant furfural flow rate. It is also within the scope of the present invention, as hereinbefore described, to control the furfural flow rate while the heavy sweet charge oil flow is maintained at a constant rate.

What is claimed is:

1. A control system for a furfural refining unit receiving heavy sweet charge oil and furfural solvent, one of which is maintained at a fixed rate while the flow rate of the other is controlled by the control system, wherein the system treats the received heavy sweet charge oil with the received furfural to yield extract mix and raffinate, comprising gravity analyzer means for sampling the heavy sweet charge oil and providing a signal API corresponding to the API gravity of the heavy sweet charge oil, flash point analyzer means for sampling the heavy sweet charge oil and providing a signal FL corresponding to the flash point temperature of the heavy sweet charge oil, viscosity analyzer means for sampling the heavy sweet charge oil and providing signals $KV_{150}$ and $KV_{210}$ corresponding to the kinematic viscosities, corrected to 150° F. and 210° F., respectively, sulfur analyzer means for sampling the heavy sweet charge oil and providing a signal S corresponding to the sulfur content of the heavy sweet charge oil, flow rate sensing means for sensing the flow rates of the heavy sweet charge oil and of the furfural and providing signals CHG and SOLV, corresponding to the charge oil flow rate and the furfural flow rate, respectively, temperature sensing means sensing the temperature of the extract mix and providing a corresponding signal T, and control means connected to all of the analyzer means, and to all the sensing means for controlling the other flow rate of the heavy sweet charge oil and the furfural flow rates in accordance with signals API, FL, $KV_{150}$, $KV_{210}$, S, T, CHG and SOLV; wherein said control means includes VI signal means connected to the viscosity analyzer means for providing a signal VI corresponding to the viscosity index of the heavy sweet charge oil in accordance with the kinematic viscosity signals $KV_{150}$ and $KV_{210}$; $SUS_{210}$ signal means connected to the viscosity analyzer means for providing a signal $SUS_{210}$ corresponding to the heavy sweet charge oil viscosity in Saybolt Universal Seconds corrected to 210° F.; W signal means connected to the viscosity analyzer means, to the gravity analyzer means and to the sulfur analyzer means for providing a signal W corresponding to the wax content of the heavy sweet charge oil in accordance with signals $KV_{210}$, API and S; A signal means connected to the gravity analyzer means, to the viscosity analyzer means, to the sulfur analyzer means, to the flash point temperature analyzer means and to the VI signal means for providing a signal A corresponding to an interim factor A in accordance with signals $KV_{210}$, S, API, VI and FL; ΔVI signal means connected to the viscosity analyzer means, to the gravity analyzer means, to the flash point temperature analyzer means, to the VI signal means, the W signal means and the $SUS_{210}$ signal means and receiving a DC voltage $VI_{RP}$ for providing a signal ΔVI corresponding to the change in viscosity index in accordance with signals $KV_{210}$, API, VI, FL, W and $SUS_{210}$ and voltage $VI_{RP}$, J signal means receiving direct current voltages $C_{80}$ through $C_{83}$ and being connected to ΔVI signal means, to the A signal means, to the temperature sensing means for providing a J signal corresponding to a furfural dosage for heavy sweet charge oil in accordance with the ΔVI signal, signals A and T, voltages $C_{80}$ through $C_{83}$ and the following equation:

$$J=(\Delta VI-C_{80}-C_{81}\sqrt{T})/[-C_{82}T+C_{83}(A)(T)],$$

where $C_{80}$ through $C_{83}$ are constants; control signal means connected to the J signal means and to the flow rate sensing means for providing a control signal in accordance with the J signal and one of the sensed flow rate signals, and apparatus means connected to the control signal means for controlling the one flow rate of the heavy sweet charge oil and furfural flow rates in accordance with the control signal.

2. A system as described in claim 1 in which the $SUS_{210}$ signal means includes SUS signal means connected to the viscosity analyzer means, and receiving direct current voltages $C_5$ through $C_{12}$ for providing a signal SUS corresponding to an interim factor SUS in accordance with signal $KV_{210}$, voltages $C_5$ through $C_{12}$ and the following equation:

$$SUS = C_5(KV_{210}) + [C_6 + C_7(KV_{210})]/[C_8 + C_9(KV_{210}) + C_{10}(KV_{210})^2 + C_{11}(KV_{210})^3](C_{12}),$$

where $C_5$ through $C_{12}$ are constants; and $SUS_{210}$ network means connected to the SUS signal means and to the ΔVI signal means and receiving direct current voltages $C_{13}$ through $C_{16}$ for providing signal $SUS_{210}$ to the ΔVI signal means in accordance with signal SUS, voltages $C_{13}$ through $C_{16}$ and the following equation:

$$SUS_{210}=[C_{13}+C_{14}(C_{15}-C_{16})]SUS,$$

where $C_{13}$ through $C_{16}$ are constants.

3. A system as described in claim 2 in which the W signal means further receives direct current voltages $C_{43}$ through $C_{49}$ and provides signal W in accordance with signals API, $KV_{210}$ and S, voltages $C_{43}$ through $C_{49}$, and the following equation:

$$W = C_{43} - C_{44}API + C_{45}/KV_{210} - C_{46}S + C_{47}(API)^2 - C_{48}API/KV_{210} + C_{48}(API)/KV_{210} + C_{49}(S)(API),$$

where $C_{43}$ through $C_{49}$ are constants.

4. A system as described in claim 3 in which the VI signal means includes K signal means receiving direct current voltages $C_2$, $C_3$, $C_4$ and $T_{150}$ for providing a signal $K_{150}$ corresponding to the kinetic viscosity of the charge oil corrected to 150° F. in accordance with voltages $C_2$, $C_3$, $C_4$ and $T_{150}$, and the following equation:

$$K_{150}=[C_2-\ln(T_{150}+C_3)]/C_4,$$

where $C_2$ through $C_4$ are constants, and $T_{150}$ corresponds to a temperature of 150° F.; $H_{150}$ signal means connected to the viscosity analyzer means and receiving a direct current voltage $C_1$ for providing a signal $H_{150}$ corresponding to a viscosity H value for 150° F. in accordance with signal $KV_{150}$ and voltage $C_1$ and the following equation:

$$H_{150}=\ln\ln(KV_{150}+C_1),$$

where $C_1$ is a constant; $H_{120}$ signal means connected to the viscosity analyzer means and receiving voltage $C_1$ for providing signal $H_{210}$ corresponding to a viscosity H value for 210° F. in accordance with signal $KV_{210}$, voltage $C_1$ and the following equation:

$$H_{210}=\ln\ln(KV_{210}+C_1),$$

$H_{100}$ signal means connected to the K signal means, to the $H_{150}$ signal means and the $H_{210}$ signal means for providing a signal $H_{100}$ corresponding to a viscosity H value for 100° F., in accordance with signals $H_{150}$, $H_{210}$ and $K_{150}$ and the following equation:

$$H_{100}=H_{210}+(H_{150}-H_{210})/K_{150},$$

$KV_{100}$ signal means connected to the $H_{100}$ signal means and receiving voltage $C_1$ for providing a signal $KV_{100}$ corresponding to a kinetic viscosity for the charge oil corrected to 100° F. in accordance with signal $H_{100}$, voltage $C_1$, and the following equation:

$$KV_{100}=\exp[\exp(H_{100})]-C_1,$$

and VI memory means connected to the $KV_{100}$ signal means and to the viscosity analyzer means having a plurality of signals stored therein, corresponding to different viscosity index and controlled by signals $KV_{100}$ and $KV_{210}$ to select a stored signal and providing the selected stored signal as signal VI.

5. A system as described in claim 4 in which the A signal means also receives direct current voltages $C_{74}$ through $C_{79}$ and provides signal A in accordance with signals $KV_{210}$, S, FL, and API, voltages $C_{74}$ through $C_{79}$, and the following equation:

$$A = C_{74} - C_{75}(KV_{210})^2 + C_{76}(S) + C_{77}(FL)^2 - C_{78}(FL)(API) - C_{79}(KV_{210})(S),$$

where $C_{74}$ through $C_{79}$ are constants.

6. A system as described in claim 5 in which the ΔVI signal means includes $VI_{DWCO}$ signal means connected to the viscosity analyzer means, to the gravity analyzer means, to the flash point temperature analyzer means, to the VI signal means, to the W signal means and receiving direct current voltages $C_{67}$ through $C_{73}$ for providing a signal $VI_{DWCO}$ in accordance with signals $KV_{210}$, VI, API, FL and W, voltages $C_{67}$ through $C_{73}$, and the following equation:

$$VI_{DWCO} = -C_{67} + C_{68}(KV_{210})^2 + C_{69}(VI) - C_{70}(API)(VI) + C_{71}(API)^2 + C_{72}(FL)(VI) - C_{73}(W)(KV_{210}),$$

where $C_{67}$ through $C_{73}$ are constants; a $VI_{DWCP}$ signal means connected to the $VI_{DWCO}$ signal means and to the $SUS_{210}$ signal means, and receiving direct current voltages $C_{21}$ through $C_{23}$ and Pour, for providing a signal $VI_{DWCP}$ in accordance with signals $VI_{DWCO}$ and $SUS_{210}$, voltages $C_{21}$ through $C_{23}$, and Pour, and the following equation:

$$VI_{DWCP} = VI_{DWCO} + (POUR)[C_{21} - C_{22}\ln SUS_{210} + C_{23}(\ln SUS_{210})^2],$$

and subtracting means connected to the $VI_{DWCP}$ signal means and to the J signal means and receiving direct voltage $VI_{RP}$ for subtracting signal $VI_{DWCP}$ from voltage $VI_{RP}$ to provide the $\Delta VI$ signal to the J signal means.

7. A system as described in claim 6 in which flow rate of the heavy sweet charge oil is controlled and the flow of the furfural is maintained at a constant rate and the control signal means receives signal SOLV from the flow rate sensing means, the J signal from the J signal means and a direct current voltage corresponding to a value of 100 and provides a signal C to the apparatus means corresponding to a new heavy sweet charge oil flow rate in accordance with the J signal, signal SOLV and the received voltage and the following equation:

$$C = (SOLV)(100)/J$$

so as to cause the apparatus means to change the heavy sweet charge oil flow to the new flow rate.

8. A system as described in claim 6 in which the controlled flow rate is the furfural flow rate and the flow of the heavy sweet charge oil is maintained constant, and the control signal means is connected to the sensing means, to the J signal means and receives a direct current voltage corresponding to the value of 100 for providing a signal SO corresponding to a new furfural flow rate in accordance with signal CHG and the J signal and the received voltage, and the following equation:

$$SO = (CHG)(J)/100,$$

so as to cause the furfural flow to change to the new flow rate.

* * * * *